US006254725B1

(12) United States Patent
Lau et al.

(10) Patent No.: US 6,254,725 B1
(45) **Date of Patent: *Jul. 3, 2001**

(54) HIGH BULK PAPER

(75) Inventors: Ralph L. Lau, Port Edwards; Bernard J. Berger; Martin E. Munce, both of Wisconsin Rapids, all of WI (US)

(73) Assignee: Consolidated Papers, Inc., Wisconsin Rapids, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/880,045

(22) Filed: Jun. 20, 1997

(51) Int. Cl.[7] ..... D21F 11/00

(52) U.S. Cl. ..... 162/135; 162/136; 162/164.1; 162/181.1; 162/203

(58) Field of Search ..... 162/203, 135, 162/136, 164.1, 181.1

(56) References Cited

U.S. PATENT DOCUMENTS

| | | | | |
|---|---|---|---|---|
| 3,124,480 | | 3/1964 | Mahoney et al. . | |
| 3,124,504 | | 3/1964 | Mahoney et al. . | |
| 3,230,867 | | 1/1966 | Nelson . | |
| 3,873,345 | | 3/1975 | Vreeland . | |
| 4,012,543 | | 3/1977 | Ranger et al. . | |
| 4,112,192 | | 9/1978 | Vreeland . | |
| 4,277,524 | | 7/1981 | Nakajima et al. . | |
| 4,606,264 | | 8/1986 | Agronin et al. . | |
| 4,670,102 | | 6/1987 | Maurer et al. . | |
| 4,861,427 | * | 8/1989 | Johnson et al. | 162/135 |
| 5,030,325 | * | 7/1991 | Saji et al. | 162/135 |
| 5,156,086 | | 10/1992 | Kiema et al. . | |
| 5,163,365 | | 11/1992 | Taylor . | |
| 5,203,967 | * | 4/1993 | Bando et al. | 162/301 |
| 5,283,129 | | 2/1994 | Renk et al. . | |
| 5,360,657 | * | 11/1994 | Kano et al. | 428/207 |
| 5,447,977 | | 9/1995 | Hansen et al. . | |
| 5,524,532 | | 6/1996 | Koivukunnas et al. . | |
| 5,614,570 | | 3/1997 | Hansen et al. . | |
| 5,753,077 | * | 5/1998 | Horand et al. | 162/135 |
| 5,853,870 | | 12/1998 | Uchimura et al. . | |
| 5,952,082 | | 9/1999 | Normington et al. . | |

FOREIGN PATENT DOCUMENTS 0 288 291 B1 5/1992 (EP) .

OTHER PUBLICATIONS

Calkin "Modern Pulp and Paper Making", Reinhold Pub. Corp, pp. 188–189, 1957.*
Another first from Austria, Paper Apr. 23, 1991.
PPI Pulp & Paper, May 1994.
ppi pulp & paper international, PPI May 1990.
Dialog Data on Japanese Appln. No. 05–274408.

* cited by examiner

*Primary Examiner*—Stanley S. Silverman
*Assistant Examiner*—Mark Halpern
(74) *Attorney, Agent, or Firm*—Pyle & Piontek

(57) ABSTRACT

A method and apparatus are disclosed for making a high bulk, coated paper of a unique structure with the coating forming a lower portion of the total caliper and the paper base forming a higher portion of the total caliper than conventionally made coated paper of the same weight. The process includes the step of using furnish with a high percentage of mechanical pulp, applying that furnish to papermachine wires, preferably with a gap former, coating the paper with a coating containing a plastic pigment, preferably of 4 or more parts per 100 parts of coating pigment, and calendering the coated paper at a nip loading less than conventional supercalendering nip loading. Preferably, the finished coated paper will have a 75° TAPPI gloss of 40 or above. The method and apparatus can be used to make lightweight or other weights of coated paper.

73 Claims, 4 Drawing Sheets

Prior Art

HIGH BULK PAPER

BACKGROUND OF THE INVENTION

Heretofore, it has been known to make lightweight, high bulk paper. For example, see U.S. Pat. No. 5,283,129, the teachings of which are incorporated herein by reference. However, that patent achieves high bulk by using coating that tends to be bulkier than conventional coating.

Other prior art attempts have been used to make high bulk coated paper by utilizing lower than conventional supercalendering nip pressures. However, these papers generally had low gloss, usually well below a 75° TAPPI gloss of 40, namely about 35. Consolidated Papers, Inc., the assignee of the present invention, had commercially sold similarly made lower gloss, high bulk papers as early as 1993. Such lower gloss paper is not acceptable for many publication purposes, such as magazines where lightweight, high bulk paper, with high gloss and good print gloss has been desired and sought for years due to ever increasing mailing rates.

BRIEF SUMMARY OF THE INVENTION

A method and apparatus is disclosed for making a high bulk, coated paper of a unique structure with the coating forming a lower portion of the total caliper and the paper base forming a higher portion of the total caliper than conventionally made coated paper of the same weight. This approach provides a bulkier, coated paper. The process includes the steps of using furnish with a high percentage, say over 50%, and preferably in a range of 55 to 75%, with a target of 60 to 65%, of mechanical pulp, or other similar pulps described herein, applying that furnish to two or twin wire papermachines, preferably with a gap former, coating the paper with a coating containing a plastic pigment in a concentration of 4 or more parts, and preferably 7 or more parts per 100 parts of coating pigment, and calendering the coated paper at a loading less than conventional supercalender loading. The use of mechanical pulp in the base sheet and a high content of plastic pigment in the coating gives a good surface finish that is easily calendered, either by lower pounds per linear inch supercalendering or hot-soft calendering to a high gloss acceptable to most publishers interested in lightweight coated paper for magazines or other similar uses. Preferably, the finished coated paper will have a 75° TAPPI gloss of 40 or above. The method or process and apparatus of the present invention can also be used to make other than lightweight grades of coated paper such as ultra lightweight coated paper. While the invention is directed toward coated paper for offset printing, it can be utilized for other coated papers for gravure, flexographic or letterpress printing.

BRIEF DESCRIPTION OF THE DRAWINGS

The present invention method, apparatus and paper itself is described in conjunction with the following drawings wherein.

DESCRIPTION OF THE PREFERRED EMBODIMENTS

As briefly discussed above, publishers and printers generally desire paper with gloss in unprinted portions and high print gloss with good ink/color properties in printed portions. Attempts have been ongoing to develop high bulk, lightweight coated papers with high print gloss.

In the present invention, a high bulk coated paper is developed which proportionally uses more base stock and less coat weight than similar grades of conventional paper of the same total weight. For example, while a conventional 30 pounds per ream paper, where herein a ream is 3300 square feet of paper, may have the following properties:

| Base Weight | Coating Weight |
|---|---|
| 22 lbs./rm | 8 lbs./rm |

paper of the present invention has:

| Base Weight | Coating Weight |
|---|---|
| 25 lbs./rm | 5 lbs./rm |

For a heavier paper of 32 lbs. per ream the data is:

| Conventional Base Weight | Conventional Coating Weight |
|---|---|
| 24 lbs./rm | 8 lbs./rm |
| Present Invention Base Weight | Present Invention Coating Weight |
| 26.5 lbs./rm | 5.5 lbs./rm |

For 38 pound paper:

| Conventional Base Weight | Conventional Coating Weight |
|---|---|
| 27 lbs./rm | 11 lbs./rm |
| Present Invention Base Weight | Present Invention Coating Weight |
| 31.5 lbs./rm | 6.5 lbs./rm |

The caliper of the papers above are as follows:

| Pound | Caliper Conventional | Caliper Present Invention |
|---|---|---|
| 30 | 1.5 to 1.65 mils | 1.75 to 1.9 mils |
| 32 | 1.6 to 1.75 mils | 1.85 to 2.0 mils |
| 38 | 1.8 to 2.0 mils | 2.0 to 2.2 mils |

The paper of the present invention, made using the method and apparatus of the present invention, would start with a waterborne furnish having a high percentage of mechanical pulp, generally in excess of 50%, usually in the 55 to 75% range, and preferably about 65%. Mechanical pulp gives a well formed base. As used herein, the term mechanical pulp may include stone ground wood (SGW), pressurized ground wood (PGW) and chemi ground wood (CGW), refiner mechanical pulp (RMP), thermal mechanical pulp (TMP), and chemi thermal mechanical pulp (CTMP). Sample furnish formulations are: (1) 45% TMP/20% SGW/35% softwood Kraft (SWK) and (2) 50% TMP/25% PGW/25% SWK. SWK is not considered a mechanical pulp. Another example might be 70–85% CTMP/30–15% SWK.

Figure 1:
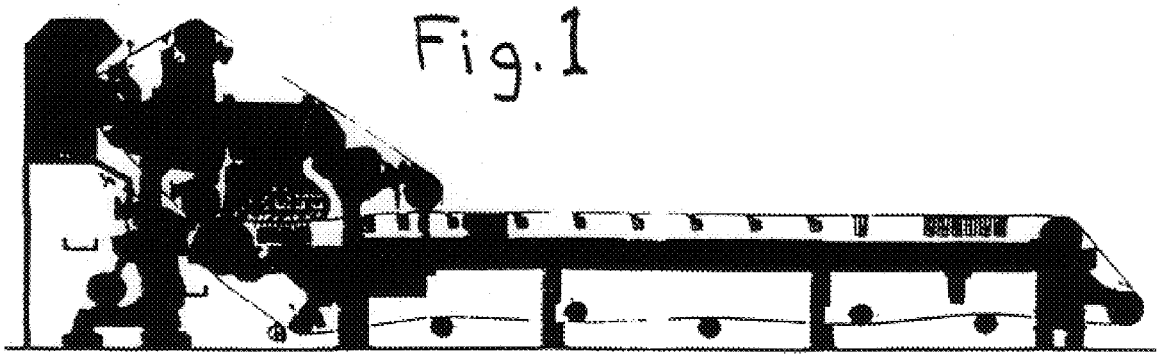
FIG. 1 shows a gap former section for use with the present invention.

The furnish preferably is utilized in a papermaking apparatus or machine having a gap former (FIG. 1) instead of a conventional fourdinier. A typical gap former for use with the present invention is a Voith-Sulzer GmbH Duo Former CFD. The gap former provides somewhat denser web base surfaces so that an AVS formation index of 75% or greater with a floc index of 15 or less and a void index of 15 or less are achieved, providing a smooth, more uniform base paper which is more easily covered with less coat weight as discussed below. The less porous paper surface reduces or minimizes coating penetration. The inherent ability of former gap to reduce two sidedness of the paper base permits achieving minimum coating application with good gloss.

Figure 2A:
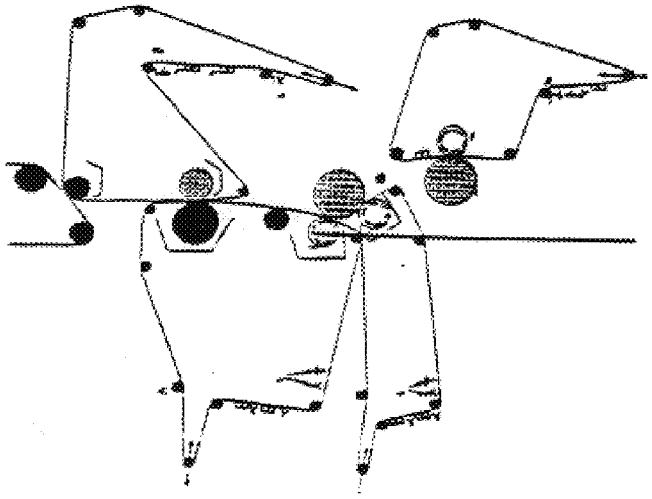
FIG. 2A shows a conventional press section.
Figure 2B:
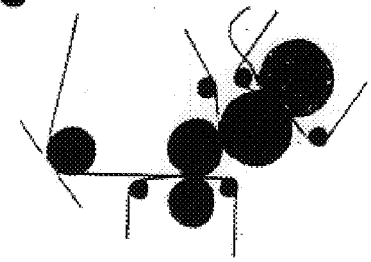
FIG. 2B shows an extended nip press section for use with the present invention.
Figure 2C:
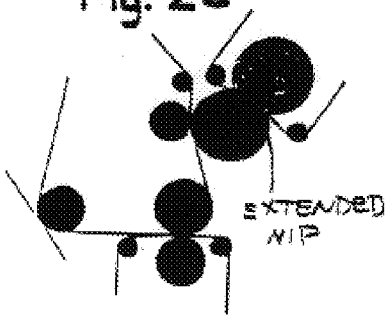
FIG. 2C shows another version of an extended nip press for use with the present invention.

The above made paper then moves into the press section wherein it can be conventionally pressed. Preferably, the press section may include a wide shoe or extended nip press (FIG. 2B or 2C) which is believed will compress the web less than is conventional, resulting in the paper web retaining more bulk and/or caliper. The extended nip press preserves bulk, yet permits water removal from the web due to the extended time the web is in the nip, which permits use of a nip pressure that is lower than conventional. Such an extended nip press is made by Beloit Corporation as model ENP-C.

Figure 3:
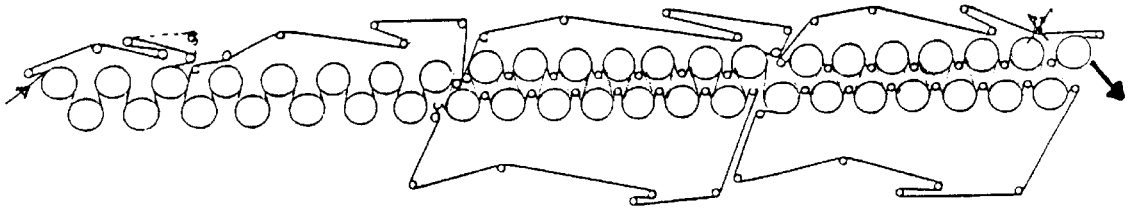
FIG. 3 shows a main dryer section for use with the present invention, which connects to FIG. 4 as shown by the heavy arrows.

The web is then sent through the dryer section (FIG. 3) and dried to a moisture content of below 10%, and preferably to 5% or less. The paper may then be coated on or off the papermaking machine.

As noted above, the coating weight applied to the web is less than conventional, but because of the smoothness and uniformity of the gap formed paper base, the paper base can be acceptably coated with a lesser amount of coating, thus yielding high bulk and allowing a given weight paper to proportionally comprise a greater percentage of paper base and a lesser percentage of coating than is conventional. Additionally, to provide increased stiffness and good gloss, the coating contains a small percentage of plastic pigment, advantageously at least 4% and preferably over 7%, and up to 20%. The amount of plastic pigment used can be increased to compensate for the use of lower amounts of mechanical pulp. Plastic pigment is relatively expensive, presently over one dollar a pound. The pigments used may be, for example, #2 clay, delaminated clay, calcined clay, $TiO_2$ and plastic pigment. The coating is generally, but need not be, applied to both sides of the paper web. A sample pigment formulation is 89% delaminated clay, 4% $TiO_2$, and 7% HSP 1055 plastic pigment made by Rohm Haas. This pigment can be made up into a typical coating with the addition of other materials as may include starch, polymeric latex binders and additives as shown below:

| | Material | Parts by Weight B.D. |
|---|---|---|
| Pigments: | Delaminated Clay | 88 |
| | $TiO_2$ | 5 |
| | HSP 1055 (Plastic Pigment) | 7 |
| Dispersant: | Sodium Polyacrylate | 0.1 |
| Binders: | Starch | 5 |
| | SBR Latex | 11 |
| | Diglyceride | 0.9 |
| Lubricant: | Water | — |
| | % Solids | 53% |

Figure 4:
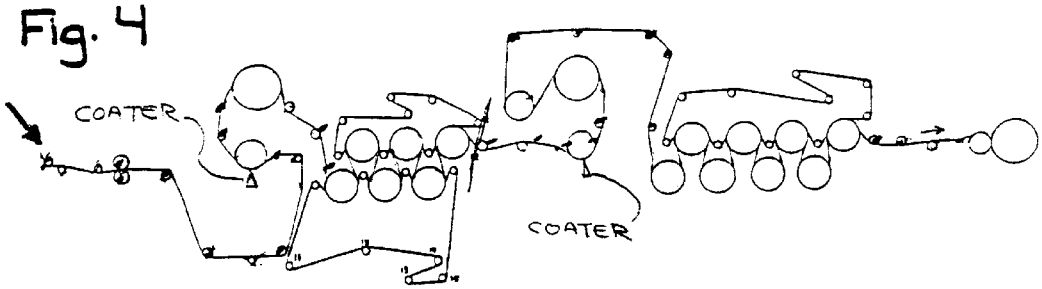
FIG. 4 shows two online coaters and accompanying coater dryers for use with the present invention.

Generally, the coating can be applied with any conventional type blade coater and preferably with a short dwell time applicator as shown in U.S. Pat. Nos. 4,250,211 and 4,512,279 (FIG. 4), and/or a fountain type coater shown in U.S. Pat. No. 5,436,030 and/or a double bladed coater as shown in U.S. Pat. No. 5,112,653, the teachings of which patents are incorporated herein by reference. In addition, the coating can be applied by a film coater or Speedcoater applicator made by Voith Sulzer GmbH, such as that shown in U.S. Pat. No. 4,848,268. While blade doctoring is preferred, other suitable types of metering, such as with a doctor rod, grooved or smooth, could be used. The term blade or blade coater as used herein, unless specifically stated, is understood to include such other equivalent metering techniques. The doctor blade shown in U.S. Pat. No. 4,780,336 has been advantageously used to provide low coat weight.

Figure 5A:
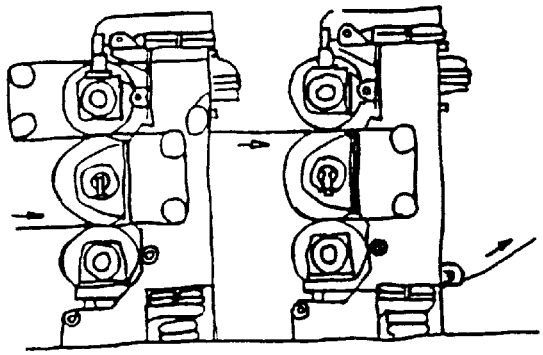
FIG. 5A shows tandem hot-soft calenders for use with the present invention.
Figure 5B:
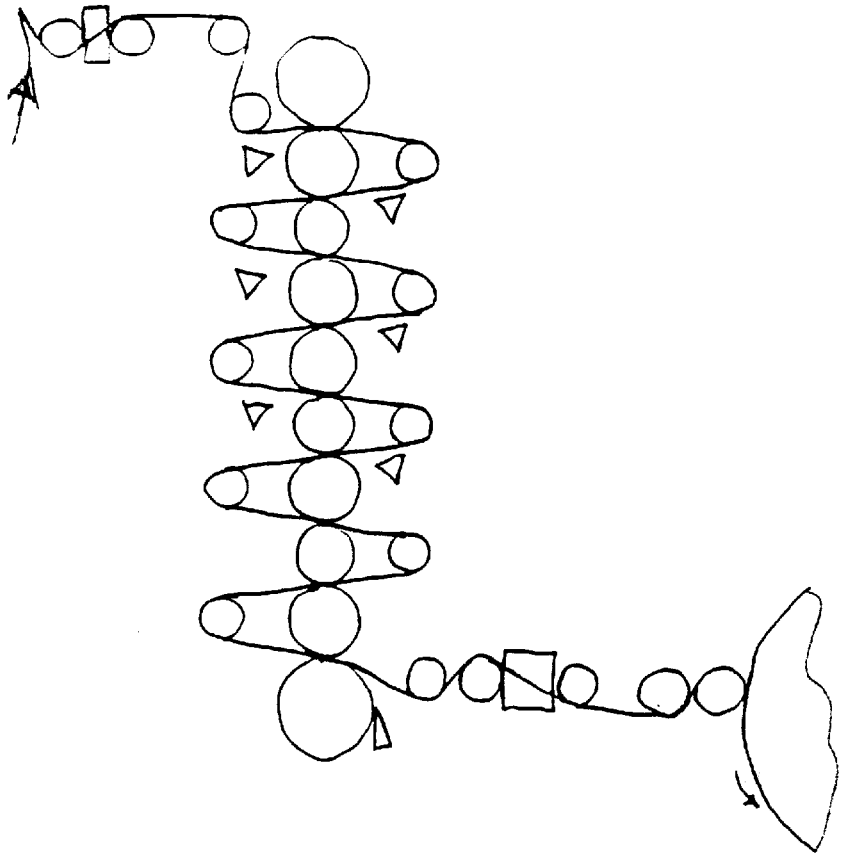
FIG. 5B shows a supercalender for use with the present invention.

The coated paper can then be calendered, preferably hot-soft calendered (FIG. 5A) and/or supercalendered (FIG. 5B), but for supercalendering the nip pressure is less than normal. The hot-soft calendering provide some improvement in bulk over supercalendering at a lower nip pressure. This improvement could be about 5 to 7% greater bulk. For example, a reduced supercalendering nip load gives a bulk factor of 58, while hot-soft calendering on the same coater paper stock at equal gloss (42) gives a bulk factor of 61. Supercalendering equipment useful in the present invention is a 10 nip supercalender made by Voith Sulzer GmbH. When used to supercalender the coated paper of the invention, the nips of the supercalender would be at a loading of only about two-thirds (⅔) of what is conventionally used. For example, supercalender loading may be 800 to 1200 pounds (per lineal inch) with 1100 to 1200 pounds being preferred and about 1150 pounds being the target, instead of the usual 1500 to 2200 pounds. Hot-soft calendering can be carried out under conventional conditions and may also take place on or off the machine. Hot-soft calendering equipment such as shown in U.S. Pat. Nos. 3,124,480, 3,124,504, 3,230,867 or 4,277,524 and/or currently made and offered by Voith Sulzer GmbH as Model No. G30 2/0 may be used. Generally, but not necessarily, supercalendering will take place off machine. However, if apparatus similar to the Janus calender made by Voith-Sulzer GmbH is used, such low nip load calendering could be performed on-line.

The resultant coated paper will generally have a bulk factor of 57–62% which can be expressed as a function of its total weight as follows:

$$\frac{\text{Caliper in mils} \times 1000}{\text{Basis weight per ream}}$$

The resultant coated paper will generally have the following characteristics as compared to conventional coated paper of the same weight:

(1) 10–20% less lineal feet/roll of paper for the same roll diameter, evidencing the higher bulk of the paper;

(2) lesser weight per roll for the same roll diameter;

(3) about 10–20% higher caliper;

(4) about 10–15% higher stiffness;

(5) about 0.5–1.0 pt. or more gain in opacity and brightness; and (6) print smoothness and gloss equivalent to conventional paper.

Some of the parameters contemplated for, and for the making of, the high bulk lightweight coated paper of the invention are:

| Basis Weight | 32 | 30 | 28 | 26 | 24 |
|---|---|---|---|---|---|
| Base Paper Weight | 26–28 | 24–26 | 22–24 | 20–22 | 18–20 |
| Coating Weight | 4–6 | 4–6 | 4–6 | 4–6 | 4–6 |
| Furnish Composition | | | | | |
| % MP | 55–75 | 55–75 | 55–75 | 55–75 | 55–75 |
| % SW Kraft | 25–45 | 25–45 | 25–45 | 25–45 | 25–45 |
| % Ash | 4–8 | 4–8 | 4–8 | 4–8 | 4–8 |
| Coating Formula | | | | | |
| Part DL Clay | 85 ± 7 | 85 ± 7 | 85 ± 7 | 85 ± 7 | 85 ± 7 |
| Part $TiO_2$ | 8 ± 4 | 8 ± 4 | 8 ± 4 | 8 ± 4 | 8 ± 4 |
| Part Plastic Pigment | 7 ± 3 | 7 ± 3 | 7 ± 3 | 7 ± 3 | 7 ± 3 |
| Part Starch | 3 ± 3 | 3 ± 3 | 3 ± 3 | 3 ± 3 | 3 ± 3 |
| Part Latex | 12 ± 3 | 12 ± 3 | 12 ± 3 | 12 ± 3 | 12 ± 3 |
| Base Paper | | | | | |
| Kajaani Formation | 65–100 | 65–100 | 65–100 | 65–100 | 65–100 |
| Supercalender | | | | | |
| # Nips/side | 1–5 | 1–5 | 1–5 | 1–5 | 1–5 |
| Nip load - pli | 1000–1400 | 1000–1400 | 1000–1400 | 1000–1400 | 1000–1400 |
| Roll Temperature ° F. | 16–225 | 160–225 | 160–225 | 160–225 | 160–225 |

While mechanical pulp is preferable, it is contemplated that other pulps could be included, such that a lower percentage of mechanical pulp would be required. Other pulps and proportions thereof contemplated for use are as follows:

| Percentage of Mechanical Pulp | Type of Other Pulp | Percentage of Other Pulp |
|---|---|---|
| A. 65% | SWK | 35% |
| B. 60% | SWK/HWK | 30%/10% |
| C. 60% | SWK/recycled | 30%/10% |

While it is preferable to use a gap former, other types of formers, such as twin wire or top wire formers, could instead be used with some small sacrifice in bulk.

For example, several or many of the above discussed factors could be used in combination to produce high bulk paper.

Factors effecting high bulk are listed as follows in decreasing order of effectiveness:

1. Low supercalender nip load or hot-soft calender;
2. Gap former;
3. Low coat weight/high substrate weight;
4. Plastic pigment in coating;
5. High % mechanical pulp;
6. High latex/starch ratio binder; and
7. Extended nip press (uncertain of the effect at the time of filing).

Combinations of factors affecting the production of high bulk paper as contemplated by the invention include (1) mechanical pulp, two wire forming, decreased base weight, increased coat weight, plastic pigment, and hot-soft calendering; (2) mechanical pulp, gap forming, increased base weight, decreased coat weight, plastic pigment coating, and supercalendering to a lower loading; (3) mechanical pulp, decreased base weight, two wire forming, extended nip or extended shoe pressing, uncured coat weight, plastic pigment coating, and hot-soft calendering or supercalendering to a lower load.

For example, the combination of:

1. increasing base substrate weight from 24#/3300 $ft^2$ to 26#/3300 $ft^2$;

2. increasing mechanical pulp in the base subtract from 52% to 65%;

3. decreasing coat weight from 8#/3300 $ft^2$ to 6#/3300 $ft^2$;

4. decreasing supercalendering intensity from 1500 pli to 1150 pli; and 5. increasing plastic pigment in the coating from 0 parts to 7 parts would increase bulk from 51±1 to 58±1 and increase L&W stiffness from 42±5 to 50±5.

Conventional 32#, Conventional 34# and High Bulk 32# are compared as follows:

| | Conventional | Conventional | High Bulk |
|---|---|---|---|
| Basis Weight #/3,300 $ft^2$ | 32 | 34 | 32 |
| Base Substrate Weight #/3,300 $ft^2$ | 24 | 25 1/2 | 26 |
| Coat Weight #/3,300 $ft^2$ | 8 | 8 1/2 | 6 |
| Caliper | 1.62 ± .04 | 1.80 ± .04 | 1.85 ± .04 |

-continued

| | Conventional | Conventional | High Bulk |
|---|---|---|---|
| Bulk Factor | 51 ± 1 | 52 ± 1 | 58 ± 1 |
| L&W Stiffness | 42 ± 5 | 55 ± 5 | 60 ± 5 |

The invention provides a high bulk lightweight coated paper that is desirable for use in magazines which require very low basis weight to reduce paper costs by increasing printing area per ton of paper and by reducing mailing cost per magazine. High bulk paper will improve the economics of publishing magazines by allowing a lower basis weight to be substituted for a higher basis weight conventional grade.

In addition, the increased stiffness of the paper of the invention improves paper web rigidity for low basis weight paper which results in better runnability on high speed printing presses and folders used to produce magazines. Further, the thicker paper produces a bulkier magazine which is less flimsy when handled. A bulkier magazine "feels more substantial" i.e., it will not droop or feel limp. Individual pages will separate easier and turn without sticking together.

Figure 6A:
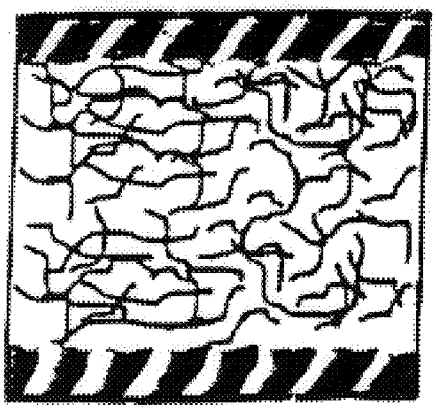
FIG. 6A shows conventional prior art lightweight coated paper of the same weight as in FIGS. 6B to 6D.
Figure 6B:
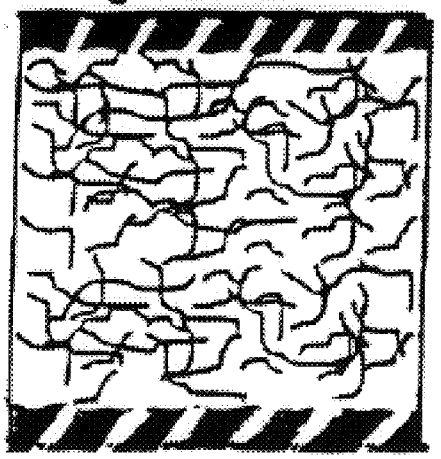
Prior Art Fig. 6B
FIG. 6B shows prior art Consolidated Papers, Inc. made coated paper.
Figure 6C:
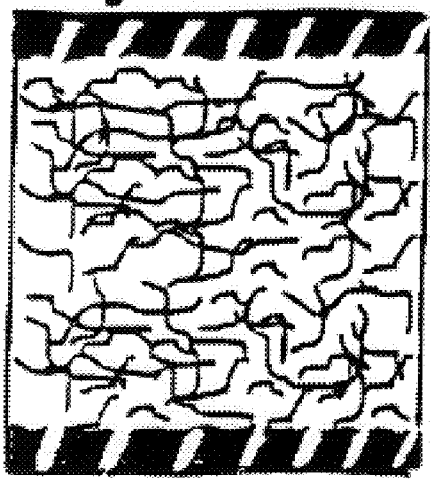
Prior Art Fig. 6C
FIG. 6C shows other prior art coated paper.
Figure 6D:
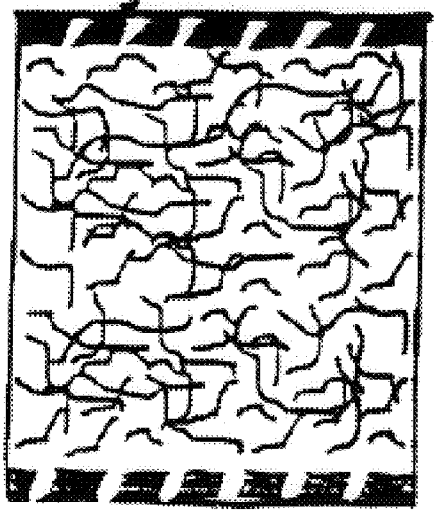
FIG. 6D shows coated paper of the present invention.

FIGS. 6A–6D schematically illustrate these different lightweight coated papers of the prior art, and a lightweight coated paper embodying the present invention, each of which has the same total weight of 30 pounds/rm. The paper of FIG. 6A is conventional lightweight coated paper and has a caliper of 1.6 mils., a base weight of 22 pounds and a coat weight of 4 pounds on each side of the base. The paper of FIG. 6B is also a conventional lightweight coated paper that was earlier made and sold by Consolidated Papers, Inc. and that has a caliper of 1.8 mils, a base weight of 23 pounds and a coat weight of 3.5 pounds on each side of the base. The paper of FIG. 6C is likewise conventional lightweight coated paper and has a caliper of 1.9 mils, a base weight of 24 pounds and a coat weight of 3 pounds on each side of the base. FIG. 6D shows a high bulk lightweight coated paper according to the teachings of the invention, which has a caliper of 2.0 mils, a base weight of 25 pounds and a coat weight of 2.5 pounds on opposite sides of the base.

It should be understood that the coating can be applied by any of the coaters discussed herein including a film coater or speed coater. As used herein, the term "blade coater" includes such film and/or speed coater.

The following table compares the effects of hot-soft calendering versus supercalendering of high bulk coated paper of 32 pound weight, where FPM means feet per minute, PLI means pounds per lineal inch, RH means relative humidity, MD means machine direction, W means web side and F means felt side:

Effect of Hot/Soft Calender vs. Super

| Sample | Supercalender | Hot/Soft Calender |
|---|---|---|
| Identification # | B641122 | B641109 |
| Web Speed-FPM | 2000 | 2500 |
| Nip Load-PLI | 1150 | 1500 |
| Temperature-° F. | 200° | 275° |
| Number of Nips/Side | 4 | 2 |
| Basis Wt. (73°/50% RH) | 32.7 | 32.9 |
| Coat Wt.W/F | 3.1/3.2 | 3.1/3.2 |
| Caliper-mils | 1.89 | 2.00 |
| Bulk Factor | 57.7 | 60.7 |
| Gloss | 42/40 | 38/40 |
| Opacity | 89.3 | 90.1 |
| L&W Stiffness-MD | 59 | 69 |
| Parker Printsurf W | 1.92 | 2.23 |
| F | 2.34 | 2.30 |
| Heidelberg Print | | |
| Print Gloss W | 54 | 49 |
| F | 46 | 52 |
| Print Density W | 1.36 | 1.30 |
| F | 1.31 | 1.31 |
| Print solid W | 4 | 5 |
| F | 4 | 5 |
| 50% Halftone W | 7.7 | 7.1 |
| F | 6.0 | 7.2 |
| Pickouts W | 54 | 53 |
| F | 52 | 54 |

The following table shows parameters involved in the production of 32 pound lightweight coated having a 75° TAPPI gloss of 45:

| | | Reels | Control | Trial | | 95% Conf. |
|---|---|---|---|---|---|---|
| SUPERED TESTS | Significance | Std / Tri | Average | Average | Difference | interval |
| Basis wt. | ** | 8 / 4 | 32.0 | 31.8 | −2.0 | ±0.2 |
| Caliper | *** | 8 / 4 | 18.3 | 18.2 | 1.9 | ±0.5 |
| Bulk | *** | 8 / 4 | 50.8 | 57.2 | 6.4 | ±1.6 |
| Opacity | | 8 / 4 | 88.1 | 88.0 | −0.1 | ±0.3 |
| Gloss Wire | * | 8 / 4 | 45 | 43 | −2 | ±2.0 |
| Gloss Felt | * | 8 / 4 | 45 | 44 | −1 | ±0.9 |
| Print Surf Wire | *** | 8 / 4 | 1.5 | 1.7 | 0.2 | ±0.1 |
| Print Surf Felt | *** | 8 / 4 | 1.6 | 1.8 | 0.2 | ±0.1 |
| L&W | *** | 8 / 4 | 42 | 47 | 5 | ±2.2 |
| HEIDELBERG | | | | | | |
| Ink Density Wire | ** | 2 / 4 | 1.44 | 1.36 | −0.08 | ±0.0 |
| Ink Density Felt | ** | 2 / 4 | 1.40 | 1.36 | −0.04 | ±0.0 |
| Ink Gloss Wire | *** | 2 / 4 | 62 | 54 | −8 | ±2.7 |
| Ink Gloss Felt | *** | 2 / 4 | 58 | 54 | −4 | ±1.8 |
| I.A. 50% Halftone W | * | 2 / 4 | 6 | 7.8 | 1.8 | ±1.6 |
| I.A. 50% Halftone F | | 2 / 4 | 6.2 | 7.3 | 1.1 | ±2.4 |

-continued

| SUPERED TESTS | Significance | Reels Std / Tri | Control Average | Trial Average | Difference | 95% Conf. interval |
|---|---|---|---|---|---|---|
| I.A. 75% Halftone W | | 2 / 4 | 5.4 | 5.8 | 0.4 | ±1.6 |
| I.A. 75% Halftone F | | 2 / 4 | 5.5 | 6.4 | 0.9 | ±3.4 |

***Significantly different @ 99% confidence level.
**Significantly different @ 95% confidence level.
*Significantly different @ 90% confidence level.

The following table shows various average results obtained with 32 pound lightweight coated paper of and made according to the present invention:

AVERAGE TEST RESULTS

| Samples | | 970097 | 970098 | 970102 | 970093 | |
|---|---|---|---|---|---|---|
| Identification | | Control | Trial 1 | Trial 2 | Trial 3 | |
| Reels | | BS41122 | BS411095 | BS411055 | BS41109 | |
| Fastening | | H/S @ Wch. | H/S @ B.P. | H/S @ S.P. | H/S @ Beloit | |
| Web Speed | | 2000 | 2500 | 2500t | 4000 | POOLED |
| Nip Load PLI | | 1150 | 1500 | 1500 | 1600 | STD. |
| Temperature ° F. | | 200 | 275 | 325 | 250 | DEV. |
| Basis Weight (Cond.) | 1 | 32.7 | 32.9 | 33.0 | 33.1 | |
| Cost Weight - W | 1 | 3.1 | 3.1 | 3.1 | 3.1 | |
| Cost Weight - F | 1 | 3.2 | 3.2 | 3.2 | 3.2 | |
| Ash | 1 | 18.0 | 17.5 | 17.5 | 17.4 | |
| Caliper | 8 | 1.89 | 2.00 | 2.02 | 2.02 | 0.02 |
| Bulk | 8 | 57.7 | 60.7 | 61.2 | 61.0 | 0.6 |
| 75° Paper Gloss - W | 8 | 42 | 38 | 38 | 38 | 1 |
| 75° Paper Gloss - F | 8 | 40 | 40 | 38 | 36 | 1 |
| Brightness - W | 2 | 70.1 | 88.4 | 86.8 | 67.9 | 0.2 |
| Brightness - F | 2 | 71.5 | 68.4 | 67.6 | 68.1 | 0.6 |
| Color 'a' - W | 2 | −0.1 | −0.1 | −0.1 | 0.0 | 0.0 |
| Color 'a' - F | 2 | 0.2 | 0.1 | 0.3 | −0.1 | 0.1 |
| Color 'b' - W | 2 | 3.2 | 4.1 | 4.8 | 3.9 | 0.2 |
| Color 'b' - F | 2 | 2.5 | 3.7 | 4.3 | 4.1 | 0.4 |
| Opacity | 8 | 89.3 | 90.1 | 90.4 | 90.0 | 0.4 |
| Undertone - W | 2 | 4 | 4 | 4 | 5 | 0 |
| Undertone - F | 2 | 4 | 4 | 4 | 5 | 0 |
| Micro. Galv. - W | 2 | 4 | 4 | 4 | 3 | 0 |
| Micro. Galv. - F | 2 | 4 | 4 | 4 | 3 | 0 |
| Tensile | 8 | 11.1 | 10.5 | 10.8 | 10.6 | 0.7 |
| Tear C.D. | 4 | 25.3 | 25.4 | 24.6 | 26.6 | 0.5 |
| L&W Stiffness | 8 | 59 | 69 | 68 | 87 | 2 |
| Scott Bond | 5 | 176 | 177 | 179 | 185 | 8 |
| H.P.D. | 8 | 127 | 117 | 101 | 110 | 10 |
| Print Surf - W | 8 | 1.92 | 2.23 | 2.33 | 2.72 | 0.10 |
| Print Surf - F | 8 | 2.34 | 2.30 | 2.45 | 2.48 | 0.08 |
| Croda Holdout - W | 2 | 60.0 | 59.5 | 60.0 | 59.0 | 1.1 |
| Croda Holdout - F | 2 | 51.5 | 60.0 | 62.0 | 61.0 | 1.1 |
| Water Drope - W | 2 | 10 | 12 | 12 | 10 | 1 |
| Water Drop - F | 2 | 10 | 11 | 12 | 9 | 1 |
| IGT, #3 @ 3.5 m/s - W | 4 | 88 | 111 | 75 | 115 | 11 |
| IGT, #3 @ 3.5 m/s - F | 4 | 70 | 98 | 102 | 108 | 11 |
| Prufbau Dry Pick - W | 2 | 4.0 | 4.0 | 4.0 | 4.0 | 0.0 |
| Prufbau Dry Pick - F | 2 | 4.0 | 4.0 | 3.0 | 4.0 | 0.0 |
| Prufbau Wet Pick - W | 1 | 5.0 | 5.0 | 5.0 | 4.0 | |
| Prufbau Wet Pick - F | 1 | 4.0 | 5.0 | 4.0 | 4.0 | |
| Adam's Wet Rub - W | 2 | 1.1 | 0.9 | 1.0 | 1.0 | 0.2 |
| Adam's Wet Rub - F | 2 | 1.6 | 1.0 | 1.2 | 1.1 | 0.1 |
| Sutherland Rub - W | 2 | 4.0 | 4.0 | 4.0 | 4.0 | 0.0 |
| Sutherland Rub - F | 2 | 4.0 | 4.0 | 4.0 | 4.0 | 0.0 |
| VC Absorbency - W | 4 | 89 | 91 | 98 | 90 | 4 |
| VC Absorbency - F | 4 | 91 | 94 | 91 | 91 | 2 |
| Heidelberg Halftone - W | 1 | 6 | 5 | 6 | 4 | |
| Heidelberg Halftone - F | 1 | 4 | 5 | 5 | 4 | |
| Heidelberg Solid - W | 1 | 4 | 5 | 6 | 4 | |
| Heidelberg Solid - F | 1 | 4 | 5 | 5 | 7 | |
| Heidelberg 50% Halftone - W | 3 | 7.7 | 7.1 | 8.7 | 8.1 | 0.3 |
| Heidelberg 50% Halftone - F | 3 | 6.0 | 7.2 | 8.2 | 8.9 | 0.5 |
| Heidelberg 75% Halftone - W | 3 | 2.7 | 4.3 | 4.8 | 1.8 | 1.5 |

-continued

AVERAGE TEST RESULTS

| Samples | | 970097 | 970098 | 970102 | 970093 | |
|---|---|---|---|---|---|---|
| Identification | | Control | Trial 1 | Trial 2 | Trial 3 | |
| Reels | | BS41122 | BS411095 | BS411055 | BS41109 | |
| Fastening | | H/S @ Wch. | H/S @ B.P. | H/S @ S.P. | H/S @ Beloit | |
| Web Speed | | 2000 | 2500 | 2500t | 4000 | POOLED |
| Nip Load PLI | | 1150 | 1500 | 1500 | 1600 | STD. |
| Temperature ° F. | | 200 | 275 | 325 | 250 | DEV. |
| Heidelberg 75% Halftone - F | 3 | 2.9 | 5.9 | 5.4 | 2.7 | 1.5 |
| Heidelberg Ink Gloss - W | 1 | 54 | 49 | 48 | 46 | |
| Heidelberg Ink Gloss - F | 1 | 48 | 52 | 50 | 44 | |
| Heidelberg Ink Density - W | 1 | 1.38 | 1.30 | 1.33 | 1.33 | |
| Heidelberg Ink Density - F | 1 | 1.31 | 1.31 | 1.32 | 1.30 | |
| Heidelberg Coating Pick - W | 1 | 25 | 33 | 38 | 34 | |
| Heidelberg Coating Pick - F | 1 | 28 | 38 | 42 | 35 | |
| Heidelberg Total Picks - W | 1 | 54 | 53 | 54 | 53 | |
| Heidelberg Total Picks - F | 1 | 52 | 54 | 51 | 50 | |

The present invention is usable in conjunction with papers for web offset, rotogravure, flexographic, letterpress and others.

As used herein the term lightcoat weight refers to papers of 30–40 pounds per ream and ultra light coat weight refers to papers of 24–28 pounds per ream. The present invention contemplates producing lightweight coated paper of high bulk with a gloss of 40 or above, and in fact Consolidated Papers, Inc. has achieved a gloss of 45. For ultra lightweight coated papers of high bulk, the present invention contemplates a gloss of 35.

While embodiments of the invention have been described in detail, various modifications and other embodiments thereof may be devised by one skilled in the art without departing from the spirit and scope of the invention, as defined in the appended claims.

What is claimed is:

1. A process for making lightweight high bulk coated paper comprising the steps of:

providing a waterborne furnish comprising at least 50% mechanical pulp;

forming a paper web by extruding the furnish onto wire sides of a papermaking apparatus with a gap former;

pressing excess water from the paper web;

drying the paper web to a moisture content of less than 10%;

coating the paper web with a coating weight;

calendering the coated paper web to a 75° TAPPI gloss of 40 or greater; and controlling at least one of said aforerecited steps so that the paper web has a caliper of at least about 88% of the total caliper of the coated paper and the coating provides substantially the remainder of the caliper of the coated paper and so that the finished coated paper has a bulk factor of at least 55.

2. A lightweight high bulk coated paper with a 75° TAPPI gloss of at least 40, comprising a paper base of a weight of 24 to 34 pounds per ream, a coating containing a plastic pigment on each side of said base, said coating being of a weight of no more than 3 pounds per ream per side, said base having a caliper of at least about 88% of the total caliper of said coated paper and said coating providing substantially the remainder of said caliper of said coated paper, said coated paper having a 75° TAPPI gloss of at least 40 and a bulk factor of at least 55.

3. An ultralightweight high bulk coated paper with a 75° TAPPI gloss of at least 35, comprising a paper base of a weight of 18 to less than 24 pounds per ream, a coating containing a plastic pigment on each side of said base, said coating being of a weight of no more than 2 pounds per ream per side, said base having a caliper of at least about 88% of the total caliper of said coated paper and said coating providing substantially the remainder of said caliper of said coated paper, said coated paper having a 75° TAPPI gloss of at least 35 and a bulk factor of no less than 55.

4. A process for making high bulk coated paper comprising the steps of:

providing a waterborne furnish comprising at least 50% mechanical pulp;

forming a paper web by extruding the furnish onto wire sides of a papermaking apparatus with a double wire former;

pressing excess water from the paper web with an extended nip press;

drying the paper web to a moisture content of less than 10%;

coating the paper web with a coating weight;

hot-soft calendering the coated paper web to a 75° TAPPI gloss of at least 40; and controlling at least one of said aforerecited steps so that the paper web has a caliper of at least about 88% of the total caliper of the coated paper and the coating provides substantially the remainder of the caliper of the coated paper and so that the finished coated paper has a bulk factor of at least 55.

5. A high bulk coated paper with a 75° TAPPI gloss of at least 40, comprising a paper base of a weight of 18 to 34 pounds per ream, a coating containing a plastic pigment on each side of said base, said coating being of a weight of no more than 3 pounds per ream per side, said base having a caliper of at least about 88% of the total caliper of said coated paper and said coating providing substantially the remainder of said caliper of said coated paper, said coated paper having a 75° TAPPI gloss of at least 40 and a bulk factor of at least 55.

6. A process for making lightweight high bulk coated paper, comprising the steps of:

providing a waterborne furnish comprising at least 50% mechanical pulp:

forming a paper web by extruding the furnish onto wire sides of a papermaking apparatus with a gap former;

pressing excess water from the paper web to provide a paper web having a base weight on the order of about 26 to 36 pounds per ream and a caliper on the order of 1.5 to 2.0 mils;

drying the paper web to a moisture content of less than 10%;

coating the paper web with a coating having a total weight on the order of 4 to 6.5 pounds/ream; and calendering the coated paper web to a caliper on the order of about 1.7 to 2.2 mils, to a 75° TAPPI gloss of 35 or greater;

wherein the base weight and the coating weight are selected so that the paper web has a caliper of at least about 75% of the total caliper of the finished coated paper and the finished coated paper has a bulk factor of at least 55.

7. A process as in claim 6, wherein said pressing step includes the step of densifying the paper web with an extended nip press to form a paper web having a floc index of from about 0 to 15, a void index of from about 0 to 15 and a Kajaani formation factor of from about 65 to 100.

8. A process as in claim 6, wherein said calendering step includes the step of hot-soft calendering the coated paper web and wherein the finished coated paper has a bulk factor of at least 58.

9. A process as in claim 6, wherein said calendering step includes the step of supercalendering the coated paper web and wherein the finished coated paper has a bulk factor of at least 58.

10. A process as in claim 6, wherein said calendering step includes the step of supercalendering the paper web at a supercalender nip loading pressure on the order of about 800 to 1200 pli.

11. A process as in claim 6; wherein said calendering step includes the step of hot-nip calendering the paper web at a nip pressure no greater than about 1500 pli.

12. A process as in claim 6; wherein said forming step includes forming a paper web having a caliper of at least about 88% of the total caliper of the finished coated paper.

13. A process as in claim 12, wherein said coating weight is selected so that coating has the remaining caliper of the finished coated paper.

14. A process as in claim 6, wherein said coating step includes coating the paper web with a coating having on the order of about 4 to 20 parts per 100 parts plastic pigment, on the order of about 0 to 6 parts per 100 parts starch and on the order of about 9 to 15 parts per 100 parts latex, and applying about one-half of the coating to each side of the paper web.

15. A process as in claim 6, wherein said coating step includes coating the paper web with a coating containing on the order of about 4 to 20 parts per 100 parts plastic pigment, on the order of about 4 to 12 parts per 100 parts $TiO_2$, and on the order of about 78% to 92% delaminated clay.

16. A process as in claim 6, wherein said coating step includes coating the paper web with a coating containing on the order of about 4 parts to 20 parts plastic pigment per 100 parts pigment of said coating.

17. A process as in claim 6, wherein said steps of forming and coating include forming a paper web with a twin wire former and that comprises on the order of about 25% to 45% softwood Kraft and on the order of about 75% to 85% by weight of the total weight of the coated paper and applying a coating to the paper web that comprises on the order of about 25% to 15% by weight of the total weight of the coated paper.

18. A process as in claim 6, wherein said forming and coating steps include forming a paper web that comprises on the order of about 80% to 85% by weight, and applying a coating to the paper web that comprises on the order of about 20% to 15% by weight, of the total weight of the coated paper.

19. A lightweight high bulk coated paper with a 75° TAPPI gloss of at least 35, comprising a paper base of a weight on the order of about 26 to 36 pounds per ream, a coating containing a plastic pigment on each side of said base, said coating being of a weight on the order of about 1.5 to 3.5 pounds per ream per side, and said base weight and said coating weight being selected so that said base has a caliper of at least about 75% of the total caliper of said coated paper and said coating provides substantially the remainder of said caliper of said coated paper, and so that said coated paper has a bulk factor of at least 55.

20. A paper as in claim 19, wherein said paper base has a floc index of from about 0 to 15, a void index of from about 0 to 15 and a Kajaani formation factor of from about 65 to 100, and said base weight and said coating weight are selected so that said base has a caliper of at least about 88% of the total caliper of said coated paper and said coating provides substantially the remainder of said caliper of said coated paper.

21. A paper as in claim 19, wherein said plastic pigment of said coating is at least 4 parts per 100 parts pigment of said coating and said coating further includes on the order of about 0 to 6 parts per 100 parts starch and on the order of about 9 to 15 parts per 100 parts latex.

22. A paper as in claim 19, wherein said plastic pigment of said coating is on the order of about 4 parts to 20 parts per 100 parts pigment of said coating and said coating further includes on the order of about 4 to 12 parts per 100 parts $TiO_2$ and on the order of about 78% to 92% delaminated clay.

23. A paper as in claim 19, wherein said base is a paper base formed by a twin wire former and comprises on the order of about 25% to 45% softwood Kraft and on the order of about 75% to 85% by weight, and said coating comprises about 25% to 15% by weight, of the total weight of said coated paper.

24. A paper as in claim 19, wherein said coating is applied in substantially equal weights on each side of said base.

25. A paper as in claim 19, wherein said base comprises at least 55% mechanical pulp.

26. A paper as in claim 19, wherein said base is a gap formed base.

27. A paper as in claim 19, wherein said base is an extended nip pressed base.

28. A paper as in claim 19, wherein said coated paper is a supercalendered coated paper and said bulk factor is at least 58.

29. A paper as in claim 19, wherein said coated paper is a coated paper that has been supercalendered at a nip pressure on the order of about 800 to 1200 pli.

30. A paper as in claim 19, wherein said coated paper is a hot-soft calendered coated paper and said bulk factor is at least 58.

31. A paper as in claim 19, wherein said coated paper is a coated paper that has been hot-soft calendered at a nip pressure no greater than about 1500 pli.

32. A paper as in claim 19, wherein said coated paper is a coated paper that has been calendered to a 75° TAPPI gloss of at least 40.

33. A process for making ultralightweight high bulk coated paper comprising the steps of:

providing a waterborne furnish comprising at least 50% mechanical pulp;

forming a paper web by extruding the furnish onto wire sides of a papermaking apparatus with a gap former;

pressing excess water from the paper web to provide a paper web having a base weight on the order of about 18 to 24 pounds per ream and a caliper on the order of about 1.5 to 2.0 mils;

drying the paper web to a moisture content of less than 10%;

coating the paper web with a coating having a total weight on the order of no more than about 4 to 6.5 pounds/ream; and calendering the coated paper web to a caliper on the order of about 1.7 to 2.2 mils and to a 75° TAPPI gloss of at least 35, wherein the base weight and the coating weight are selected so that the base has a caliper of at least about 75% of the total caliper of the finished coated paper and so that the finished coated paper has a bulk factor of at least 55.

34. A process as in claim 33, wherein said pressing step includes the step of densifying the paper web with an extended nip press to form a paper web having a floc index of from about 0 to 15, a void index of from about 0 to 15 and a Kajaani formation factor of from about 65 to 100.

35. A process as in claim 33, wherein said calendering step includes the step of hot-soft calendering the coated paper web at a nip pressure no greater than about 1500 pli.

36. A process as in claim 33, wherein said calendering step includes the step of supercalendering the paper web at a supercalender nip loading on the order of about 800 to 1200 pli.

37. A process as in claim 33, wherein said step of coating the paper web includes the step of applying a coat weight of 2 or less pounds per ream on a side of the paper web with a coating having on the order of about 4 to 20 parts per 100 parts plastic pigment on the order of about 0 to 6 parts per 100 parts starch and on the order of about 9 to 15 parts per 100 parts latex, and the coated paper has a bulk factor of at least 58.

38. A process as in claim 33, wherein said forming step includes forming a base with a twin wire former and that comprises on the order of about 25% to 45% softwood Kraft and on the order of about 75% to 85% by weight of the total weight of the coated paper and having a caliper of at least about 88% of the total caliper of the finished coated paper.

39. A process as in claim 33, wherein said coating step includes coating the paper web with a coating containing on the order of about 4 to 20 parts per 100 parts plastic pigment, on the order of about 4 to 12 parts per 100 parts $TiO_2$, and on the order of about 78% to 92% delaminated clay and applying to a side of the web coating that is no more than about 6% of the total caliper of the finished coated paper.

40. A process as in claim 33, wherein said coating step includes applying to each of the two sides of the web coating that in total is no more than about 15% of the total caliper of the finished coated paper.

41. A process as in claim 40, wherein said coating step includes applying about one-half of the coating to each side of the paper web.

42. A process as in claim 33; wherein said coating step includes coating the paper web with a coating containing plastic pigment.

43. A process as in claim 33, wherein said steps of forming and coating include forming a base that comprises on the order of about 75% to 85% by weight of the total weight of the coated paper and applying a coating to the base that comprises about 25% to 15% by weight of the total weight of the coated paper.

44. A process as in claim 33, wherein said forming and coating steps include forming a base that comprises about 80% to 85% by weight, and applying a coating to the base that comprises about 20% to 15% by weight, of the total weight of the coated paper.

45. An ultralightweight high bulk coated paper with a 75° TAPPI gloss of at least 35, comprising a paper base of a weight on the order of about 18 to 24 pounds per ream, a coating containing a plastic pigment on each side of said base, said coating being of a weight of no more than about 2 pounds per ream per side, and said base weight and said coating weight being selected so that said base has a caliper of at least about 75% of the total caliper of the finished coated paper and so that the finished coated paper has a bulk factor of at least 55.

46. A paper as in claim 45, wherein said said coating has on the order of about 4 to 20 parts per 100 parts plastic pigment, on the order of about 0 to 6 parts per 100 parts starch and on the order of about 9 to 15 parts per 100 parts latex.

47. A paper as in claim 45, wherein said base has a floc index of from about 0 to 15, a void index of from about 0 to 15 and a Kajaani formation factor of from about 65 to 100 and comprises about 75% to 85% by weight, and said coating comprises about 25% to 15% by weight, of the total weight of said coated paper.

48. A paper as in claim 45, wherein said base comprises at least 88% of the total caliper of said coated paper.

49. A paper as in claim 45, wherein said coating contains on the order of about 4 to 20 parts per 100 parts plastic pigment, on the order of about 4 to 12 parts per 100 parts $TiO_2$, and on the order of about 78% to 92% delaminated clay and said coating weight on at least one side of said web comprises about 1.0 to 20 pounds per ream and the finished coated paper has a bulk factor of at least 58.

50. A paper as in claim 45, wherein said coating is applied in substantially equal weight on each side of said base.

51. A paper as in claim 45, wherein said base is a base formed on a twin wire former and comprises at least 55% mechanical pulp.

52. A paper as in claim 45, wherein said base is a gap formed base.

53. A paper as in claim 45, wherein said coated paper is a supercalendered coated paper and the bulk factor of the finished coated paper is at least 58.

54. A paper as in claim 45, wherein said coated paper is a coated paper that has been supercalendered at a nip loading on the order of about 800 to 1200 pli.

55. A paper as in claim 45, wherein said coated paper is a hot-soft calendered coated paper and the bulk factor of the finished coated paper is at least 58.

56. A paper as in claim 45, wherein said coated paper is a coated paper that has been hot-soft calendered at a nip loading on the order of no more than about 1500 pli.

57. A paper as in claim 45, wherein said coated paper has a 75° TAPPI gloss of at least 40.

58. A process for making high bulk coated paper comprising the steps of:

providing a waterborne furnish comprising at least 50% mechanical pulp;

forming a paper web having a weight on the order of about 18 to 34 pounds per ream by extruding the furnish onto wire sides of a papermaking apparatus with a double wire former;

pressing excess water from the base with an extended nip press to provide a paper web of a caliper on the order of about 1.5 to 20 mils;

drying the paper web to a moisture content of less than 10%;

coating the paper web with a coating weight on the order of about 4 to 6.5 pounds per ream; and hot-soft calendering the coated paper web to a caliper on the order of about 1.7 to 2.2 mils and to a 75° TAPPI gloss of at least 40;

wherein said weights of said paper web and said coating are selected so that said paper web has a caliper of at least about 85% of the total caliper of the finished coated paper and a bulk factor of at least 55.

59. A process as in claim 58, wherein said step of coating the paper web includes coating the paper web with a coating having on the order of about 4 to 20 parts per 100 parts plastic pigment, on the order of about 0 to 6 parts per 100 parts starch and on the order of about 9 to 15 parts per 100 parts latex, and applying a coat weight of 3 or less pounds per ream on a side of the paper web.

60. A process as in claim 58, wherein said forming step includes forming a paper web having a caliper no greater than about 88% of the total caliper of the finished coated paper.

61. A process as in claim 58, wherein said coating step includes applying to a side of the web coating containing on the order of about 4 to 20 parts per 100 parts plastic pig on the order of about 4 to 12 parts per 100 parts $TiO_2$, and on the order of about 78% to 92% delaminated clay, and that is no more than about 6% of the total caliper of the finished coated paper.

62. A process as in claim 58, wherein said coating step includes applying about one-half of the coating to each side of the paper web.

63. A process as in claim 58, wherein said coating step includes coating the paper web with a coating containing plastic pigment.

64. A process as in claim 58, wherein said step of forming the paper web includes forming a base having a weight of about 18 to 34 pounds per ream.

65. A process as in claim 58, wherein said steps of forming and coating include forming a base with an extended nip press to form a paper web having a floc index of from about 0 to 15 a void index of from about 0 to 15 and a Kajaani formation factor of from about 65 to 100 and that comprises about 75% to 85% by weight of the total weight of the coated paper and applying a coating to the base that comprises about 25% to 15% by weight of the total weight of the coated paper.

66. A process as in claim 58, wherein said steps of forming and coating include forming a base with a twin wire former and that comprises on the order of about 25% to 45% softwood Draft and on the order of about 80% to 85% by weight of the total weight of the coated paper and applying a coating to the base that comprises about 20% to 15% by weight of the total weight of the coated paper.

67. A high bulk coated paper with a 75° TAPPI gloss of at least 40, comprising a paper base of a weight of 18 to 34 pounds per ream, a coating containing a plastic pigment on each side of said base, said coating being of a weight of no more than 3 pounds per ream per side, said base weight and said coating weight being chosen so that said base has a caliper of at least about 85% of the total caliper of said coated paper and said coating provides substantially the remainder of said caliper of said coated paper and so that the finished coated paper has a bulk factor of at least 55.

68. A paper as in claim 67, wherein said coating has on the order of about 4 to 20 parts per 100 parts plastic pigment on the order of about 0 to 6 parts per 100 parts starch and on the order of about 9 to 15 parts per 100 parts latex.

69. A paper as in claim 67, wherein said base is a base formed with an extended nip press and has a floc index of from about 0 to 15, a void index of from about 0 to 15 and a Kajaani formation factor of from about 65 to 100 and comprises about 75% to 85% by weight, and said coating comprises about 25% to 15% by weight, of the total weight of said finished coated paper.

70. A paper as in claim 67, wherein said contains on the order of about 4 to 20 parts per 100 parts plastic pigment, on the order of about 4 to 12 parts per 100 parts $TiO_2$, and on the order of about 78% to 92% delaminated clay and said coating weight on at least one side of said web comprises about 1.0 to 3.0 pounds per ream.

71. A paper as in claim 67, wherein said coating is applied in substantially equal weights on each side of said base.

72. A paper as in claim 67, wherein said base is a base formed with a twin wire former and comprises at least 55% mechanical pulp.

73. A process for making ultralightweight high bulk coated paper, comprising the steps of:

providing a waterborne furnish comprising at least 50% mechanical pulp;

forming a paper web by extruding the furnish onto wire sides of a papermaking apparatus with a gap former;

pressing excess water from the paper web;

drying the paper web to a moisture content of less than 10%;

coating the paper web with a coating weight;

calendering the coated paper web to a 75° TAPPI gloss of at least 35; and controlling at least one of said aforerecited steps so that the paper web has a caliper of at least about 85% of the total caliper of the coated paper and the coating provides substantially the remainder of the caliper of the coated paper and so that the finished coated paper has a bulk factor of at least 55.

* * * * *

UNITED STATES PATENT AND TRADEMARK OFFICE

CERTIFICATE OF CORRECTION

PATENT NO. : 6,254,725 B1
DATED : July 3, 2001
INVENTOR(S) : Ralph L. Lau, Bernard J. Berger and Martin E. Munce It is certified that error appears in the above-identified patent and that said Letters Patent is hereby corrected as shown below:

Column 17,
Line 25, delete "pig" and insert -- pigment, --

Signed and Sealed this

Twenty-eighth Day of May, 2002

*Attest:*

*Attesting Officer*

JAMES E. ROGAN
*Director of the United States Patent and Trademark Office*